US005878550A

United States Patent [19]

Cahill et al.

[11] Patent Number: 5,878,550

[45] Date of Patent: Mar. 9, 1999

[54] PACKETS AND THEIR MANUFACTURE

[75] Inventors: Michael John Cahill, Kenilworth; Geoffrey William Vernon, High Wycombe, both of England

[73] Assignee: Lipton, Division of Conopco, Inc., Englewood Cliffs, N.J.

[21] Appl. No.: 62,352

[22] Filed: Apr. 17, 1998

Related U.S. Application Data

[62] Division of Ser. No. 724,339, Oct. 1, 1996, Pat. No. 5,855, 938, which is a continuation of Ser. No. 417,306, Apr. 5, 1995, abandoned.

[30] Foreign Application Priority Data

Apr. 7, 1994 [GB] United Kingdom ..... 9406833

[51] Int. Cl.[6] ..... B65B 29/04

[52] U.S. Cl. ..... 53/413; 53/134.2

[58] Field of Search ..... 426/80, 82, 83; 493/88, 226, 375; 53/413, 134.2

[56] References Cited

U.S. PATENT DOCUMENTS

| | | | |
|---|---|---|---|
| 2,334,256 | 11/1943 | Eaton . | |
| 2,335,159 | 11/1943 | Salfisberg . | |
| 2,350,930 | 6/1944 | Salfisberg . | |
| 2,406,018 | 8/1946 | Irmscher . | |
| 2,466,281 | 7/1949 | Shaw . | |
| 2,881,910 | 4/1959 | Murphy . | |
| 3,143,834 | 8/1964 | Irmscher . | |
| 3,191,355 | 6/1965 | Morpurgo | 53/134.2 |
| 3,237,550 | 3/1966 | Christopher . | |
| 3,316,686 | 5/1967 | Welin-Berger . | |
| 3,539,355 | 11/1970 | Kasakoff . | |
| 4,382,355 | 5/1983 | Romagnoli | 53/134.2 |
| 4,856,257 | 8/1989 | Romagnoli | 53/134.2 |
| 5,135,762 | 8/1992 | Vernon et al. | 53/134.2 X |
| 5,399,224 | 3/1995 | Vernon et al. | 53/134.2 X |
| 5,511,359 | 4/1996 | Kenney | 53/134.2 X |
| 5,527,419 | 6/1996 | Vernon et al. | 53/134.2 X |
| 5,632,132 | 5/1997 | Kuipers et al. | 53/134.2 X |

FOREIGN PATENT DOCUMENTS

| | | |
|---|---|---|
| 118215 | 3/1944 | Australia . |
| 1169388 | 9/1958 | France . |
| 661 905 | 8/1987 | Switzerland . |
| 910 724 | 11/1962 | United Kingdom . |
| 91/13580 | 9/1991 | WIPO . |
| 92/06903 | 4/1992 | WIPO . |

*Primary Examiner*—Daniel B. Moon
*Attorney, Agent, or Firm*—James J. Farrell

[57] ABSTRACT

Infusion packets have envelopes of heat-sealable material with a looped thread within the packets to wring moisture from the packet in use. A central part of the thread loop is held in a widened region of one edge seal while the ends of the loop project through the opposite edge seal in which they are movable when the loop is to be contracted. The packets are produced by forming a continuous series of thread loops on one elongate web and placing doses of infusion material on a second elongate web before bringing the webs together with the thread loops and infusion material between them. The two webs are then welded together and the individual packets are separated from the joined webs.

23 Claims, 3 Drawing Sheets

PACKETS AND THEIR MANUFACTURE

This application is a divisional of Ser. No. 08/724,339 filed Oct. 1, 1996, now U.S. Pat. No. 5,855,938, which is a continuation of Ser. No. 08/417,306 filed Apr. 5, 1995, now abandoned.

BACKGROUND OF THE INVENTION

This invention relates to packets in which a quantity of infusible material is held in a porous envelope which can be immersed in water to prepare an infusion. It is also concerned with a method of producing such packet and with apparatus for producing the packets.

When an infusion is prepared using such a packet a quantity of infused liquid is retained in the packet usually both by the infusible material and by the material of the packet envelope, and mechanical means have been proposed for extracting at least some of that liquid by applying pressure to the packet. In particular, it has been proposed as a convenient and hygienic solution to provide the packet with draw strings which can be manipulated to contract the packet. Examples of such packets are disclosed in U.S. Pat. Nos. 3,539,355, 3,237,550, 2,881,910 and 2,466,281.

In U.S. Pat. Nos. 3,539,355, 2,881,910 and 2,466,281 a draw string or thread passes through holes in the walls of the packet, which is thus liable to leak its contents before use. Moreover, pulling on the draw strings will create high stress concentrations at the edges of the holes, with the risk of tearing and the spillage of a quantity of the infused material into the infusion as the packet is being wrung out over it. Strengthening the walls of the packet is not a solution because of cost and because it is likely to impair the efficiency of infusion.

In U.S. Pat. No. 3,237,550 a string loop passes around the packet, the ends of the loop being held captive by a staple punched through an edge of the packet. Pulling the ends apart to shorten the loop contracts the packet. The staple must hold the ends sufficiently loosely to allow them to slide easily when the ends are pulled apart, but not so loosely that it allows the loop to slacken and slip off the other end of the packet, or the ends to slip out of the staple. It will be appreciated that close manufacturing tolerances must be maintained to ensure satisfactory use of such packets and the arrangement is thus ill-suited to economical large scale production. It is also a feature of this form of packet that the wringing action is concentrated along the centre line of the packet and the side edge regions may retain a considerable part of the liquid when the loop is tightened. A somewhat analogous arrangement is shown in U.S. Pat. No. 3,539,355, in which a stiff paper strip takes the place of the string loop. This similarly does not adapt itself to economical large scale production.

It is also known from WO91/13580, WO92/06903 and CN 93103319.5 to locate a loop of thread within a packet, an intermediate portion of the loop being anchored in a heat sealed side edge margin of the packet and the ends of the loop projecting out of the opposite side edge margin. The presence of the thread in the edge seals, and in particular in the side edge anchoring the intermediate portion of the loop, weakens the seals however. This effect is intensified by the local stresses generated on the edge seal when tension is applied to the loop ends to wring moisture from the bag consequently rupture of the bag can too easily occur and the infusion material be spilled. Furthermore, these proposals for wringable infusion packets do not disclose any way in which the packets can be reasonably produced in large quantities.

SUMMARY OF THE INVENTION

According to one aspect of the present invention, there is provided an infusion packet comprising opposite layers of porous sheet material heat-sealed together to form an envelope containing infusible material, and a draw string or thread between said layers having an intermediate portion of its length held between said layers at a first heat-sealed peripheral region of the packet, respective portions of the thread extending from opposite ends of said intermediate portion to be located between said layers at a further region or regions spaced from said first region after crossing over each other in their paths from said first region, and continuing from said further region or regions to project from the packet to provide gripping ends which can be pulled apart to apply a wringing action to the packet, an edge seal of said first peripheral region projecting inwardly relative to edge seals of adjacent peripheral regions continuing from the ends of said first region, the intermediate portion of the draw string or thread being so located in said first region edge seal that it emerges from the ends of said first region inwardly of the edge seals of said adjacent regions to extend between said layers.

By locating an intermediate portion of the thread in an edge seal region that projects inwards of the adjacent edge seal regions, when the thread loop is pulled to wring the packet the stresses at the portions of the thread emerging from the anchoring seal region have less tendency to break the seal between the packet walls as compared with an arrangement in which the thread simply extends inwards from a uniform width seal, as in the prior art examples referred to above having an internal thread loop. The thread can be held in a margin of the edge seal that is not needed for the sealing of the bag edges, so that if the bag walls are separated in that region the bag itself is not ruptured. With said first region and said further region or regions at opposite side edges of the packet it: is possible to ensure an efficient wringing action over most if not all the area of the packet.

The thread main portions may extend diagonally across each other between said first and further regions, through the area which the infusion material is located. Preferably, in the further region or regions there are passages in the secured edges between the layers in which the thread is itself releasably secured so as to be detachable from and slidable in said passages when pulled to apply the wringing action. The attachment of the thread may act to seal the thread although if the thread runs obliquely through said further region or regions the length of said passages can be increased independently of the width of the seal in said secured edges, so that it less likely that there will be any spillage of the packet contents.

In another aspect, the invention provides a method of producing infusion packets containing doses of infusible material, in which a thread forming a pattern comprising a longitudinally spaced series of loops is enclosed between opposed heat-sealable packet walls of porous material, portions of the thread between said loops projecting from the packets to provide a means for contracting said loops when in use, said walls being secured together to form enclosed packages by heat-sealing the edges of said packets, each packet edge seal having a first region securing an intermediate portion of the thread, in the production of packets, the looped thread being placed against one of a pair of webs of said porous material and a second of said webs being placed against the first web with the thread loops between the webs before the edges of the webs are heat-sealed together along their length and the webs are sealed together transversely at intervals along their length to divide them into a series of sealed compartments each having a thread loop and a dose of said infusible material, the separation of said compartments from the webs providing the packets, said sealing of the webs leaving channels for said portions of the thread between the loops to project from the packets.

An advantage of such a method of producing the packets is that it can operate in a continuous manner, the thread being laid in said pattern of loops in a continuous length, preferably before being brought together with said one web, and the individual loops being separated from each other after they are secured to said one web. Conveniently the material to be packaged is placed on the other of the webs before it is brought together with said one web and the looped thread thereon.

A further aspect of the invention provides apparatus for producing packets of infusible material comprising means for bringing a pair of webs together and for locating between the webs spaced doses of the infusible material and a series of correspondingly spaced loops of a thread, each dose and corresponding loop being associated with an individual packet divided from the joined webs, the apparatus further comprising sealing means for sealing the peripheries of the packets to enclose said doses of infusible material, means being provided for dividing the joined webs into packets each having a dose of said material and corresponding thread loop and for separating the ends of each thread loop from the loops of adjoining packets.

The end portions of each loop may be secured to an edge region of the webs, preferably in an easily releasable manner. The intermediate region may be secured to an opposite edge region of the webs and if so this is preferably done simultaneously with the securing of said end portions.

To form the loops a tubular delivery member may be provided as a thread guide, an outlet end of the member from which the thread is dispensed being displaceable in a circulatory path by drive means acting on the delivery member to form said loops.

In a preferred arrangement of the apparatus, the loops are formed upon a roller by means of which they are carried on one of said webs to be attached thereto before the webs are brought together.

To lay the thread in an optimum form of loop may require the speed of delivery of the thread to vary in the course of forming the loop. To limit the tension produced in the thread by the cyclical acceleration, suction means may be provided to maintain a free loop of thread in a feed line to the delivery device, whereby the rate of delivery from said free loop can be varied relative to the rate of feed thereto.

The invention will be further described by way of example with reference to the accompanying drawings.

DESCRIPTION OF THE PREFERRED EMBODIMENTS

Figure 1:
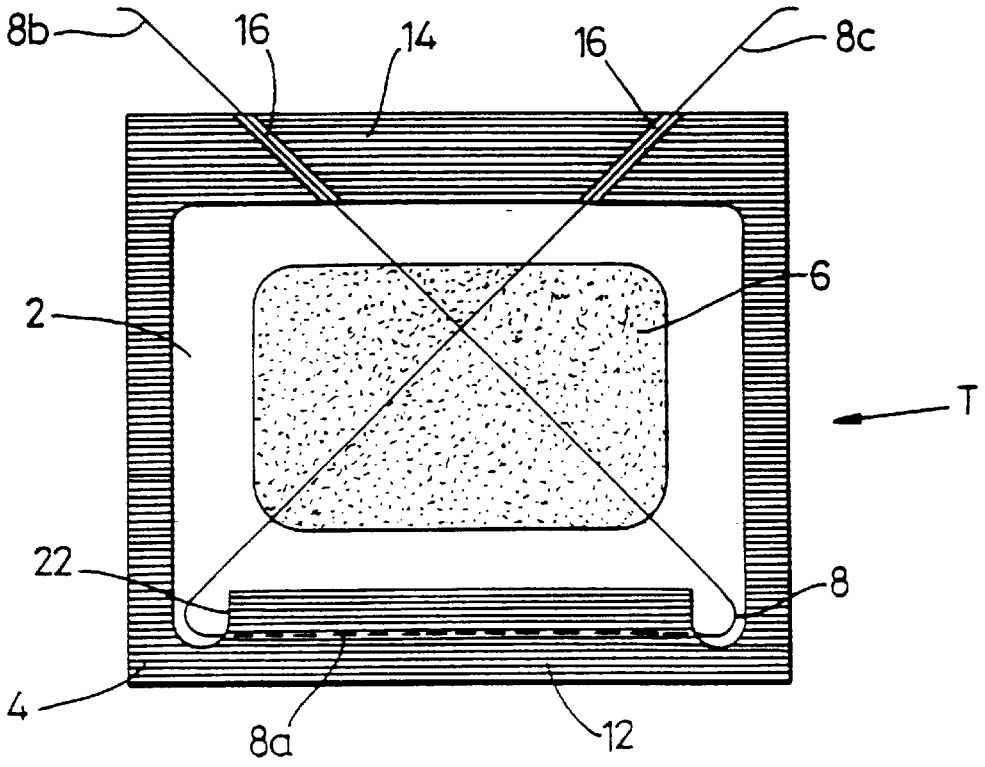
FIG. 1 illustrates an infusion packet according to the invention.

FIG. 1 illustrates a tea bag T which comprises two identical layers 2 of conventional heat sealable paper, eg. Dexter 7146, heat sealed together around their peripheries with a crimped or flat seal 4. Within the peripheral seal 4 a dose 6 of infusible material is held between the two paper layers. A length of thread 8 is also sandwiched between the layers in a loop pattern, its crossed ends emerging from an upper edge of the tea bag.

A central portion 8*a* of the thread is firmly fixed by the heat seal 4 where it is between the layers in a wider, lower edge portion 12 of the seal. The two ends 8*b*,8*c* of the thread emerge from the peripheral seal at opposite ends of the wider lower edge portion 12 and extend between the layers, diagonally oppositely across the tea bag, and through the upper edge seal 14. Within the upper edge seal the two ends of the thread are held in narrow channels 16 where the paper layers are more lightly sealed together than the remainder of the peripheral seal. The retention of the thread by the heat seal material in these channels can easily be sheared by pulling on the exposed thread ends and the thread is then able to slide in these channels. It is possible alternatively to leave the channels 16 unsealed if they are sufficiently restricted to avoid any significant leakage of the contents of the bag.

In use, after the tea in the bag has been infused, the tea bag may be removed from the liquid, held by the free ends 8*b*,8*c* of the thread which are then pulled apart. Although this frees them to slide in the channels 16 they are still held within those channels and between the ends the thread 8 is still firmly secured by the wider lower edge seal portion 12. The bag itself is therefore contracted and puckered by the tension in the thread so that the infusible material within it is subjected to a wringing action to extract infusion liquid in the bag.

The top and bottom sealing margins 12,14 through which the thread 8 passes are made relatively wide to increase their resistance to tearing or delamination when the thread ends are pulled to apply a wringing force. Reliefs 22 at the ends of the lower edge portion 12 give a relatively wide seal area there to take the force that the thread applies across the seal. The relatively wide upper edge seal 14 also has the advantage of increasing the length of the channels 16 and so reducing any tendency of particles of the infusible material to escape along these restricted routes when the seal in them is broken.

Figure 2:
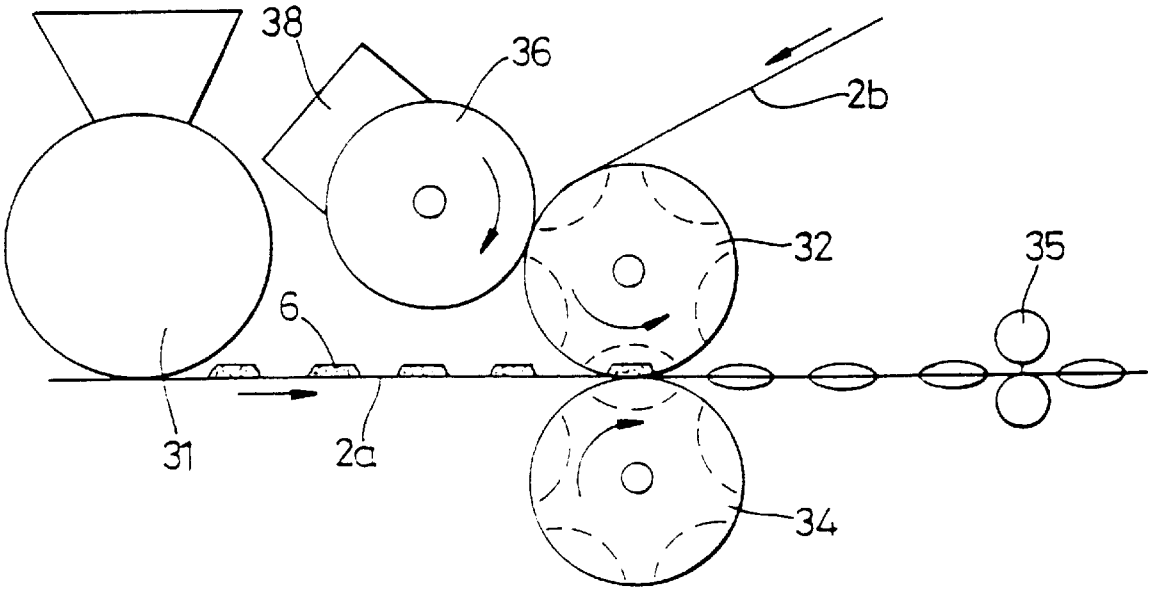
FIG. 2 is a schematic illustration of a part of a process for producing a series of packets of the form shown in FIG. 1.

Tea bags of the illustrated form can be produced in a continuous process as outlined in FIG. 2. This shows a first web 2*a* of the heat sealable paper carrying spaced doses 6 of infusible material, which have been deposited by a dosing wheel 31 in known manner, and a second similar web 2*b* joining the first web to enclose the doses between the webs. The second web 2*b* enters around the upper one of a pair of heat seal rollers 32,34 and the two webs sealed together as they come together in the nip between the rollers to form the peripheral seals 4 before the individual tea bags are separated. Adjacent the path of the web over the upper roller 32 is a third roller 36 with which is associated a thread positioning mechanism 38 for deploying the thread in its looped pattern on the periphery of the third roller. As the laid thread comes adjacent the upper roller 36 it is attached to the web 2*b* running over that roller and is so carried on its web to be sandwiched between the two webs 2*a*,2*b* as they pass through the heat seal rollers 32,34. Following severing rollers 35 separate the individual packets and also cut the thread between the packets.

The sealing pattern impressed by the rollers 32,34 preferably comprises crimped lines running in the direction of movement of the webs, in particular in the lower edge region where the central portion 8*a* of the thread is fixed, parallel to the crimped lines. In this manner the portion 8*a* can be fixed without risk to the integrity of the seal.

Figure 3:
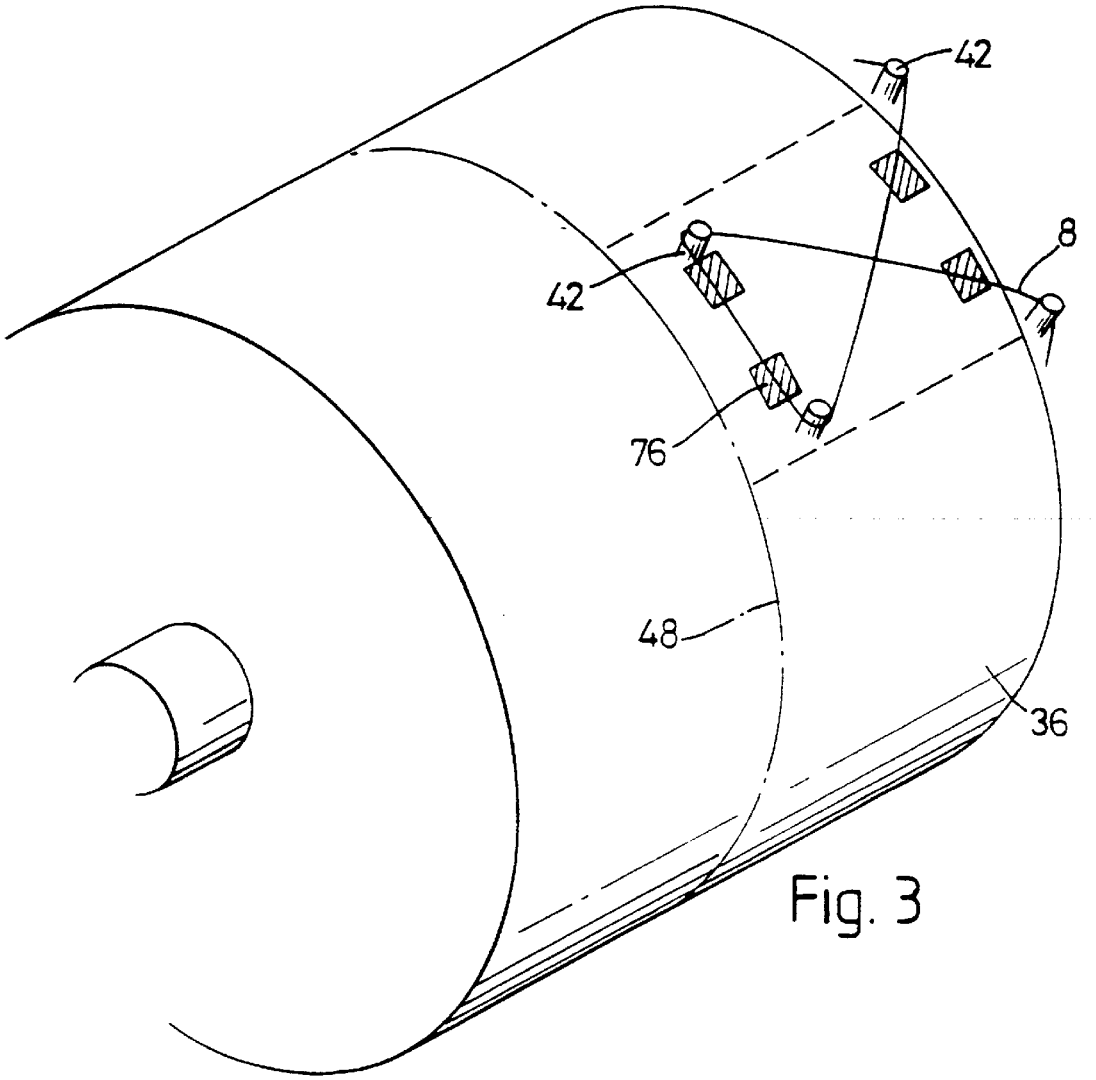
FIG. 3 illustrates a means for forming the thread loops.
Figure 4:
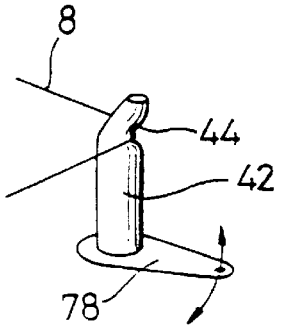
FIG. 4 is a detail illustration sharing a feature of the arrangement in FIG. 3.
Figure 6:
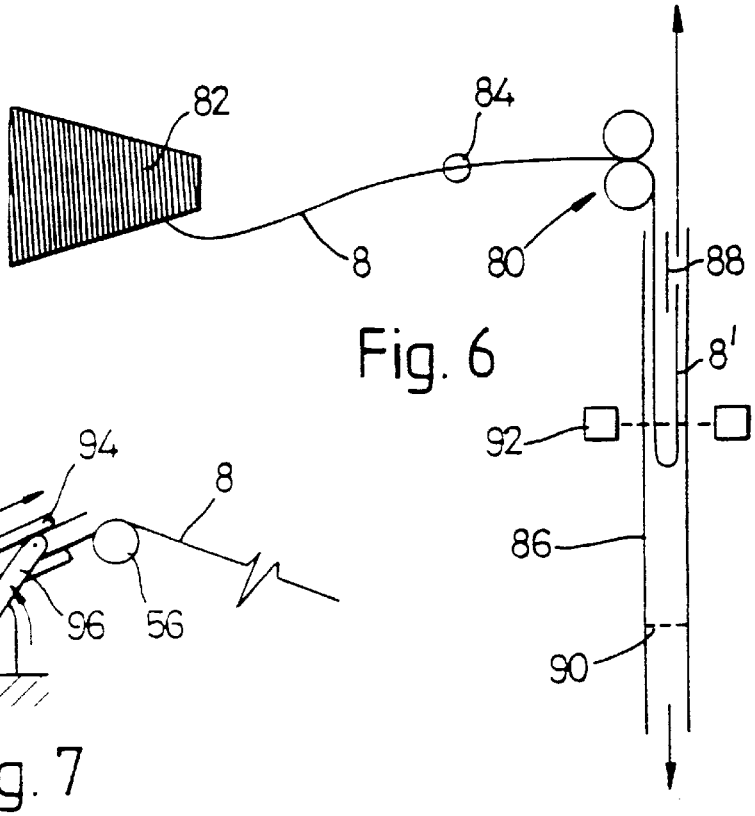
FIG. 6 illustrates a tension control device for the thread feed means.

FIGS. 3 and 4 show some details of carrier means on the third roller 36 for the thread deployed from the positioning mechanism, arranged to allow a continuous series of spaced thread loops to be formed on the periphery of the roller at a pitch corresponding to the width of the tea bags. For each thread loop there is an arrangement of four projecting pins 42 provided with notches 44 (FIG. 4) or hooks or both near their outer ends, so arranged as to catch a thread that is laid around them by a dispensing wand (FIG. 4 or FIG. 6). It will be noted that the thread is shown disposed entirely to one side of a centre line 48 indicating a radial plane at the middle of the axial length of the roller. A similar thread loop pattern can therefore be laid on the other half of the roller periphery, in mirror image to the illustrated thread pattern. With this arrangement the webs 2*a*,2*b* are double the width of the individual tea bags so as to form two rows of bags side by side, the bags being separated from each other after they have been fully formed. Because the thread for each row does not extend over the centre of the web width, the two thread loop patterns are formed and secured independently of each other.

Figure 5:
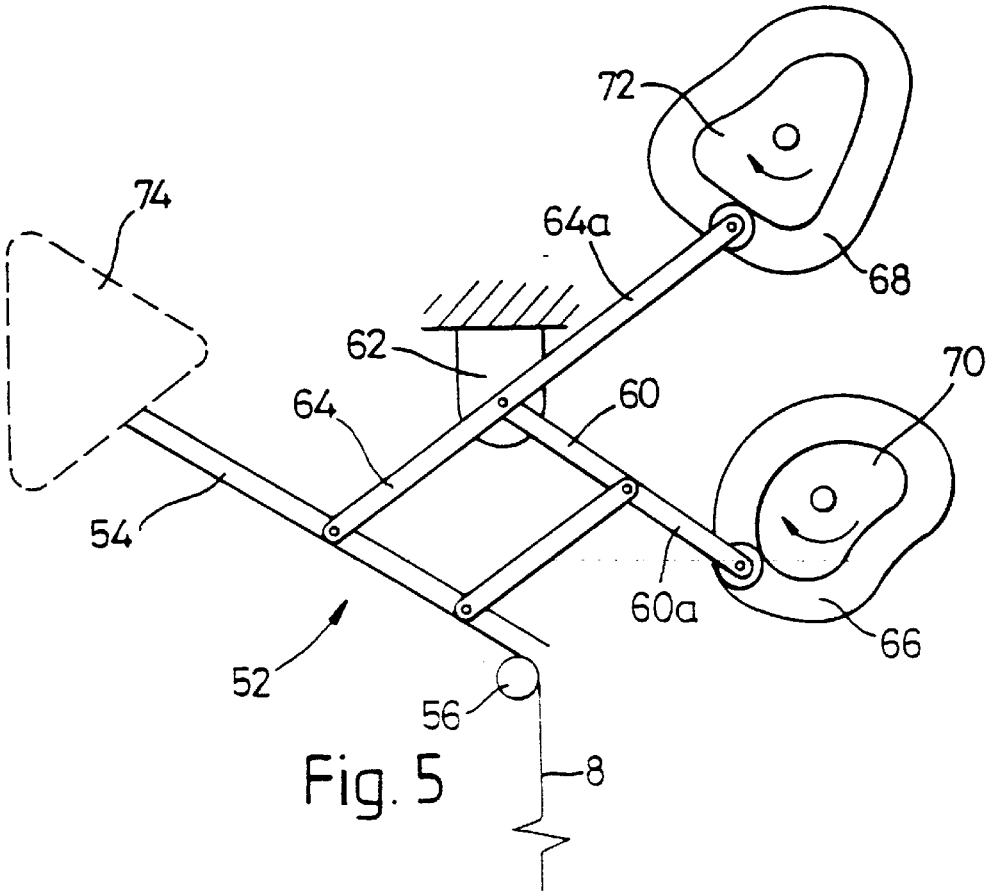
FIG. 5 illustrates one form of thread feed mechanism for forming the loops.

FIG. 5 illustrates a first wand mechanism for positioning the thread on the carrier means of the roller 36. The mechanism comprises a parallelogram linkage one of the arms of which is formed by a wand 52 in the form of an elongate tube 54 through which the thread is fed over an entry guide roller 56. One of the pivots of the arm 60 parallel to the wand has a fixed anchorage 62 arm 60 and a further arm 64 of the linkage have extensions 60*a*,64*a* carrying followers which are guided in closed tracks 66,68 of respective rotary cams 70,72. The cams 70,72 are rotated in synchronism and their tracks 66,68 are so shaped that the thread exit end of the wand 52 orbits on a path 74 in the form of an approximately triangular loop.

Because the third roller 36 is rotating as the wand tip describes its loop-forming orbit, the thread 8 reaches the surface of the roller and is laid around successive sets of pins 42 in a series of loops which are spaced at intervals around the roller periphery, one such loop being shown in FIG. 3. These loops are temporarily retained by the notches or hooks 44 of the pins. In the portions of the periphery of the third roller associated with each loop a set of four heatable sealing pads 76 are provided in locations which are crossed by the thread 8. As the third roller rotates each loop is brought in turn to the paper web 2*b* entering the apparatus around the upper roller 32 and the associated sealing pads 76 are then heated to tack the thread to the web. The tacked thread loops are immediately released from the carrier means of the third roller 36 and travel onwards with the web 2*b*. The pads 76 are so located that the tacking welds are in zones that are overlaid eventually by the edge seal portions 12 and 14 of the tea bags.

To hold the thread loops stably on the third roller 36 before transfer to the web 2*b* and to ensure transfer without snagging, the pins 42 are preferably displaceably mounted on the roller. For example, the pins may be radially displaceable to be lowered flush with the third roller periphery when the loops are transferred; this displacement may be obtained by holding the pins resiliently in their projecting positions or by providing a cam-operated mechanism to draw the pins in. The thread may be sprung over the ends of the pins 42 as they are retracted if it is held by hooks or notches 44 such as are shown in FIG. 4. It may be desired, however, to rotate the pins, eg. by a cam mechanism operating on an arm 78 (FIG. 4) of each pin, at the moment of transfer to facilitate the release of the looped thread from the third roller.

Whatever way the transfer is effected, it is preferable to ensure that by this stage the thread has been drawn taut into the loop pattern assumed in the finished tea bag. It is particularly desirable to locate as precisely as possible the ends 8*a*,8*b* that pass through the passages 16 in the upper edge seal 14 in order to keep the width of the passages to a minimum.

Forming the loop patterns with the thread may require significant variations of velocity of the thread as it emerges from the wand. It is desirable to ensure that accelerations imposed on the thread do not lead to excessive tension loads. FIG. 6 illustrates a thread feed mechanism for limiting thread tension which comprises a motorised drive device 80 drawing the thread 8 from a bobbin 82 through an entry guide eyelet 84. Downstream of the drive device the thread runs in an open loop 8' depending into the outer end of a suction tube 86. A central barrier 88 in the tube keeps the two lengths of the loop separate and a pervious screen 90 limits the penetration of the loop into the tube. Between the barrier 88 and the screen 90 the presence of the thread loop is detected by a sensing device 92, eg. a light-sensitive device, which is connected to a control circuit (not shown) for the drive device 80.

If the thread loop 8' is too short to reach the sensing device the drive 92 is operated to draw more thread from the bobbin. As thread gathers to lengthen the loop 8' it triggers the sensing device 92 and the drive is stopped or slowed. The distance of the sensing device from the barrier 90 and the rate at which the drive device 80 draws thread from the bobbin ensure that the thread loop 8' is always maintained at such a length that it will not tighten around the barrier 88. Apart from any friction in the wand, the tension load on the thread feed to the third roller 36 is thus limited to the suction force applied to it in the tube 86.

Figure 7:
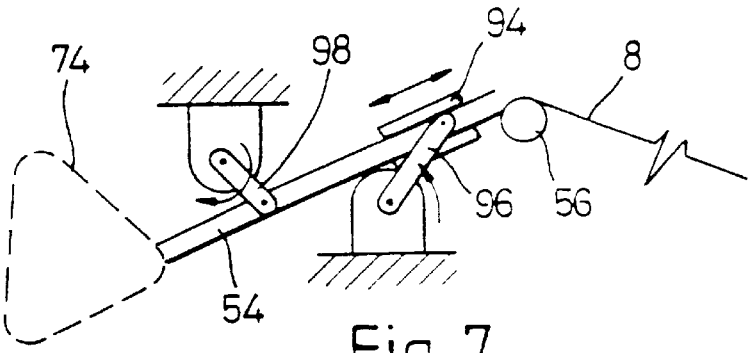
FIG. 7 illustrates an alternative thread feed device for forming the loops.

FIG. 7 illustrates an alternative mechanism for generating the looped path 74 of the tip of the wand 54 required to place the thread around the pins 42 on the third roller 36. The wand is held slidably in a longitudinally fixed but pivotable guide 94 so that it can move longitudinally in the guide under the action of a first driven crank 96. A second driven crank 98 pivoted to the wand remote from the guide swings the wand tip laterally and by coordination of the movements of the two cranks the required loop-form path is produced for the wand tip.

We claim:

1. A method of producing infusion packets having opposed packet walls of heat-sealable porous material containing doses of infusible material, comprising the steps of:

(i) forming a thread in a pattern of loops in a longitudinally spaced series lying against a first of a pair of elongate webs of said porous material, (ii) placing a second of said pair of webs against the first web with longitudinal edges of the webs coincident and said loops located between the webs, between said loops the thread comprising portions projecting laterally from one longitudinal edge of the elongate webs, (iii) locating doses of the infusible material in a longitudinally spaced series between the webs, (iv) after placing the second web against the first web, heat-sealing the webs together at their longitudinal edges and transversely at intervals along their length between said doses to form a series of sealed compartments each having a thread loop and a dose of said infusible material, (v) said heat-sealing of the webs together leaving channels through which said portions of the thread between the loops extend to project from the webs, (vi) separating the sealed compartments to form the infusion packets each having a thread loop and a dose of said infusible material and having said portions of the thread at opposite ends of the loop projecting from the packet to provide a means for contracting said loop when in use to apply a wringing action to the packet.

2. A method according to claim 1 wherein the thread is laid in said pattern of spaced loops and is thereafter transferred and secured to said first web.

3. A method according to claim 1 wherein said doses of infusible material are deposited on the second of said webs before it is placed against the first web.

4. A method according to claim 1 wherein the thread is detachably secured to the webs by heat-sealing at said channels for the projecting portions of the thread.

5. A method according to claim 1 wherein the thread loops of the respective packets are severed from each other simultaneously with said separation of the sealed compartments forming the packets.

6. A method according to claim 1 wherein the thread is laid in said pattern of spaced loops against the first web overlapping a side edge of said web to provide said projecting thread portions.

7. A method of producing infusion packets having opposed packet walls of heat-sealable porous material containing doses of infusible material, comprising the steps of:

(i) forming a thread into a pattern of spaced loops, (ii) after forming said loops locating the loops as a longitudinally spaced series along a face of a travelling web, (iii) portions of thread extending between successive loops being left projecting outwardly from a longitudinal edge of said one web face, (iv) enclosing said loops between said first web face and a second web face having a longitudinal edge coincident with said edge of said one web face, (v) dispensing doses of the infusible material to be enclosed as a series of spaced doses between said first and second web faces each dose being in juxtaposition to a respective thread loop, (vi) heat-sealing said first and second web faces together to form a series of sealed compartments, each having a thread loop and a dose of said infusible material, said faces thereby providing opposed internal walls of the compartments, (vii) separating the sealed compartments and simultaneously the thread loops to form the infusion packets each having a respective thread loop and dose of said infusible material.

8. A method according to claim 7 wherein the thread is laid in said pattern of spaced loops around a series of pins fixed relative to each other in positions defining said loop pattern.

9. A method according to claim 8 wherein the thread is laid around said pins by a guide moving in a fixed, predetermined path.

10. Apparatus for producing packets of infusible material, comprising (i) a conveying mechanism for bringing a pair of elongate webs together, (ii) a thread dispensing and forming mechanism for locating a thread against a first of the webs in a pattern of a longitudinally spaced series of loops, (iii) a material dispensing mechanism for locating between the webs longitudinally spaced doses of the infusible material, (iv) a sealing mechanism for sealing the webs together along their longitudinal edges and transversely at intervals along their length to form a series of sealed compartments each having a thread loop and a dose of the infusible material, and (v) a severing mechanism for separating the said compartments to form individual packets each having a dose of said material and a corresponding thread loop and for separating opposite ends of each said loop from the loops of adjoining packets.

11. Apparatus according to claim 8 wherein the thread dispensing and forming mechanism comprises a roller having a peripheral face on which said thread loops are formed and are carried onto said web to be attached thereto before the two webs are brought together.

12. Apparatus according to claim 11 wherein the thread dispensing and forming mechanism comprises loop-forming means for laying the thread onto said roller peripheral face in said pattern of loops.

13. Apparatus according to claim 12 wherein said loop-forming means comprises a delivery member through which the thread passes to be laid onto the roller, and a drive mechanism connected to the delivery member for displacing the member to form said pattern of the thread loops on the roller peripheral face.

14. Apparatus according to claim 11 wherein projecting location elements are provided on the roller peripheral face for holding the thread in the form of said loops, said location elements being displaceable inwardly of said face for assisting the transfer of the loops to the web.

15. Apparatus according to claim 11 wherein the roller is provided with a heating device to attach the loops to said web by heat sealing.

16. Apparatus according to claim 10 comprising a suction device for maintaining a free loop of thread in a feed line of thread to said thread dispensing and forming mechanism whereby to limit the feed tension of the thread travelling to said web.

17. Apparatus according to claim 10 wherein the thread dispensing and forming mechanism is located between the material dispensing mechanism and the sealing mechanism for sealing the webs together.

18. Apparatus for producing packets of infusible material comprising (i) a conveying mechanism for drawing heat-sealable web material along a web path, (ii) a thread carrier, (iii) a thread dispensing and forming mechanism for laying a thread onto said carrier in a series of loops, (iv) said carrier being adapted to carry the thread loops laid thereon to said web path for locating the loops against a first face of the web material in a pattern of loops longitudinally spaced along said face, (v) a web guidance arrangement in the web path downstream of said carrier for enclosing said pattern of loops between said first face and a second face of web material overlying said first face, (vi) a material dispensing mechanism upstream of said guidance arrangement for dispensing longitudinally spaced doses of the infusible material to be enclosed between said faces in juxtaposition with respective spaced thread loops, (vii) a sealing mechanism for sealing together said overlying web faces to form a series of sealed compartments each having a thread loop and a dose of the infusible material, and (viii) a severing mechanism for separating the sealed compartments to form individual packets each having a dose of said material and a corresponding thread loop, and for simultaneously separating opposite ends of each thread loop from the loops of adjoining packets.

19. Apparatus according to claim 18 wherein the carrier comprises a roller having a peripheral face on which said thread loops are formed and are carried onto said first web face.

20. Apparatus according to claim 19 wherein the thread dispensing and forming mechanism is displaceable to lay the thread onto said roller peripheral face in said pattern of loops.

21. Apparatus according to claim 20 wherein said forming mechanism comprises a thread-carrying member through which the thread is carried onto said peripheral face, and a drive mechanism connected to said member for displacing the member to form said pattern of the thread loops on the roller peripheral face.

22. Apparatus according to claim 19 wherein location elements project from the roller peripheral face for holding the thread in the form of said loops, said location elements being displaceable into said face for assisting the transfer of the loops to said first face.

23. Apparatus according to claim 19 wherein the roller is provided with a heating device to attach the loops to the web material by heat sealing.

* * * * *